US005632164A

United States Patent [19]

Bergagnini

[11] Patent Number: 5,632,164

[45] Date of Patent: May 27, 1997

[54] JEWELRY PENDANT ASSEMBLY

[75] Inventor: Norberto Bergagnini, Garden City, N.Y.

[73] Assignee: Sandberg & Sikorski Diamond Corp., New York, N.Y.

[21] Appl. No.: 590,609

[22] Filed: Jan. 24, 1996

[51] Int. Cl.[6] ..... A44C 25/00

[52] U.S. Cl. ..... 63/23; 63/28

[58] Field of Search ..... 63/13, 23, 28, 63/32

[56] References Cited

U.S. PATENT DOCUMENTS

| | | | |
|---|---|---|---|
| D. 339,311 | 9/1993 | Ambar . | |
| 1,421,339 | 6/1922 | Zalowitz . | |
| 1,854,958 | 4/1932 | Santossuosso | 63/28 |
| 1,958,946 | 6/1934 | Gautieri . | |
| 2,033,288 | 3/1936 | Kmicic . | |
| 2,058,978 | 10/1936 | Hamin . | |
| 2,080,317 | 6/1937 | Jaeckel . | |
| 3,670,524 | 6/1972 | Korwin | 63/23 X |
| 3,931,719 | 1/1976 | Schwab . | |
| 4,222,245 | 9/1980 | Vitau . | |
| 4,503,687 | 3/1985 | Tessler et al. . | |
| 4,761,865 | 8/1988 | Magnien et al. . | |
| 5,123,265 | 6/1992 | Ramot . | |

*Primary Examiner*—Kien T. Nguyen
*Attorney, Agent, or Firm*—Gottlieb, Rackman & Reismam, P.C.

[57] ABSTRACT

A jewelry pendant assembly is provided. The assembly comprises a frame member having an outside edge and an inside edge, the latter defining a window therethrough. Also provided is a series of interrelated and interconnected jewelry stones mounted together in a substantially planar array and which are mounted behind said frame member.

17 Claims, 2 Drawing Sheets

FIG. 3
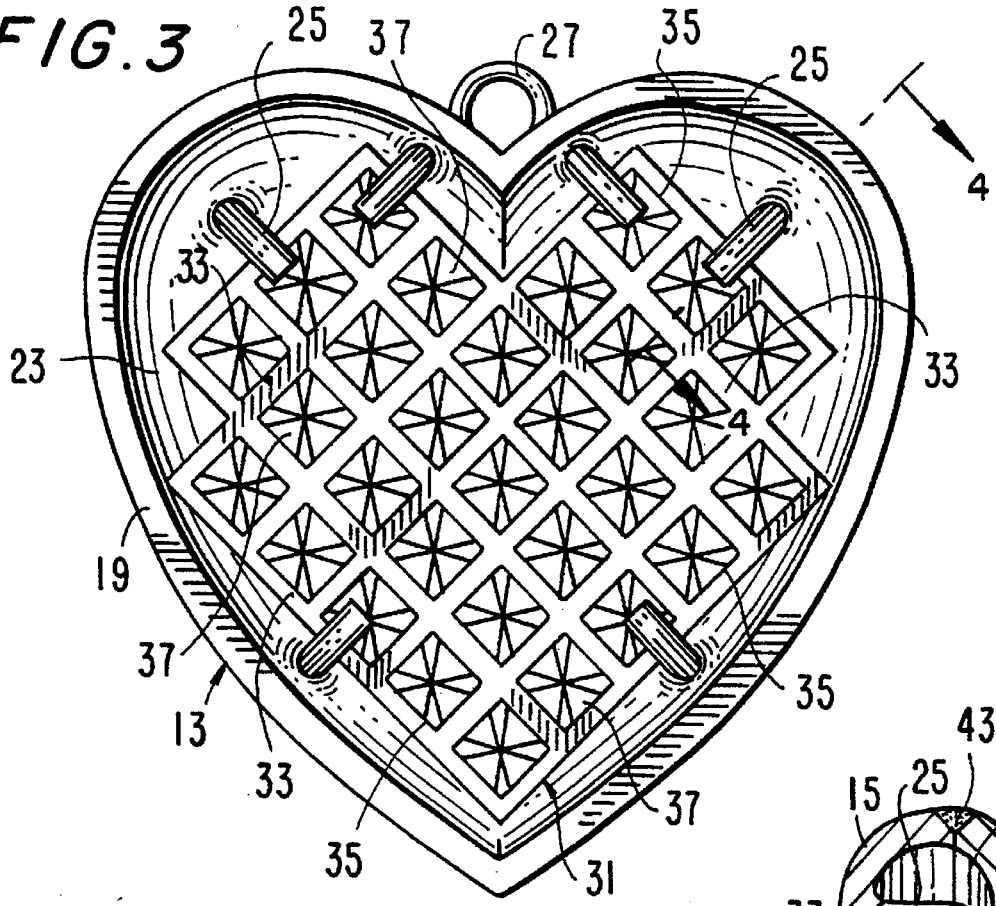
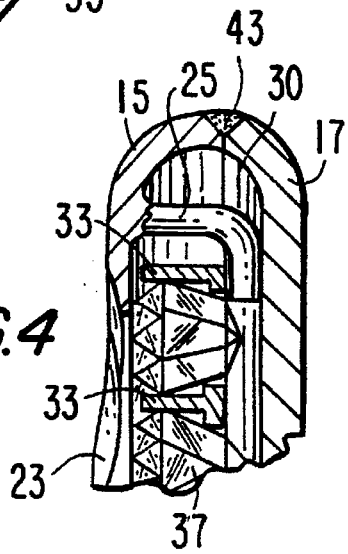
FIG. 4
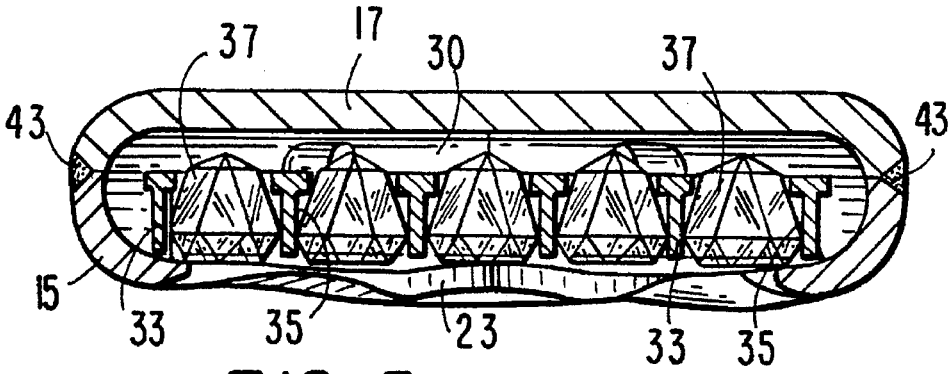
FIG. 5

JEWELRY PENDANT ASSEMBLY

BACKGROUND OF THE INVENTION

This invention relates to a jewelry pendant assembly, and more particularly, to a jewelry pendant assembly in which a series of diamonds or other stones is formed in an array and mounted behind a pendant frame.

A well known design in the jewelry art is the "invisible setting," in which a series of diamonds or other stones is formed in an planar array. The stones are mounted without any setting or prongs that are visible to the observer. In such prior art pendant designs, the frame of the pendant typically rests up against the outside edge or border of the stone array. Consequently, the stones located on the outside or border of the array must be cut to very specific configurations. This enables the jewelry stone array to abut flush against the frame in an aesthetically pleasing fashion. As a result, the frame of this type of assembly can only have a design of a fairly simple construction. Otherwise, extensive design work would be required by the stonecutter to size the stones appropriately in order to fit within the frame.

Accordingly, it would be desirable to provide a jewelry pendant assembly in which the frame thereof can have as intricate construction or design as desired, without the need for specially cutting the stones of the stone array.

SUMMARY OF THE INVENTION

Generally speaking, in accordance with the invention, a jewelry pendant assembly is provided. The assembly comprises a frame member having an outside edge and an inside edge, the latter defining a window therethrough. Also provided is a series of interrelated and interconnected jewelry stones mounted together in a substantially planar array and which define an outside border running thereabout.

An array of jewelry stones is sized to fit substantially behind the frame member, such that the outside border thereof is completely hidden from view through the window of the frame member. The outside border of the jewelry stone array is positioned between the inside and outside edges of the frame member so that the inside edge of the frame member sits substantially over the jewelry stone array inwardly of its outside border.

As can be appreciated, the frame of the pendant assembly of the invention sits over, or on top of an array of stones. As a result, the frame of the pendant can have any design configuration which is desired, as the outside stones of the stone array will sit, at least in part, underneath the frame, and do not need to be specifically cut to fit inside the frame. In other words, a standardized jewelry stone array may be created for use with any number of different pendant designs.

Accordingly, it is an object of the invention to provide a jewelry pendant assembly.

Another object of the invention is to provide a jewelry pendant assembly in which the stone array thereof is not specifically designed for the pendant frame.

A further object of the invention is to provide a jewelry pendant assembly in which standardized stone arrays may be produced for multiple numbers of pendant frames.

Yet another object of the invention is to provide a jewelry pendant assembly in which the frame design is not limited by the shape of the stone array mounted therewithin.

Other objects and advantages of the invention will in part be obvious and will in part be apparent from the following description.

The invention accordingly comprises the product design possessing the features, properties and relation of components which will be exemplified in the designs hereinafter described, and the scope of the invention will be indicated in the claims.

BRIEF DESCRIPTION OF THE DRAWINGS

For a fuller understanding of the invention, reference is made to the following description, taken in connection with the accompanying drawings, in which:

FIG. 3 is an elevational view showing the jewelry stone array depicted in FIG. 2 mounted within the pendant frame;

FIG. 4 is a cross-sectional view taken along line 4—4 of FIG. 3; and FIG. 5 is a cross-sectional view taken along line 5—5 of FIG. 1.

DETAILED DESCRIPTION OF THE PREFERRED EMBODIMENT

Figure 2:
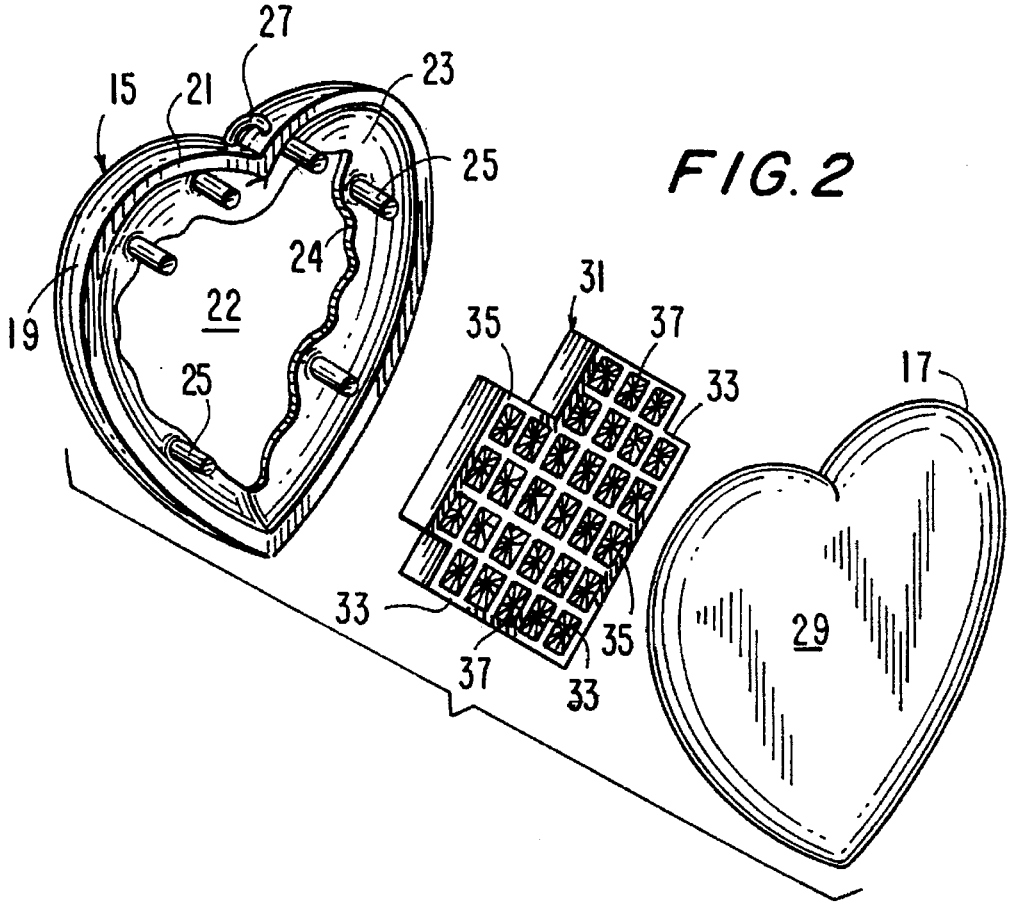
FIG. 2 is an exploded perspective view of the components of the jewelry pendant assembly depicted in FIG. 1.

Referring first to FIG. 2, the component parts of the inventive jewelry pendant assembly, generally indicated at 11, are now described. Pendant assembly 11 comprises a frame assembly generally indicated at 13 and an array of stones generally indicated at 35. Pendant assembly 13 comprises a front frame member 15 and a back frame member 17. Front frame member 15 has an exposed front surface 19 and a hidden inside surface 23, as shown in FIG. 2. Inside surface 23 of front member 15 is formed with a series of projecting prongs 25 that are used for capturing stone array 31 within frame member 15 (see FIG. 3).

Figure 1:
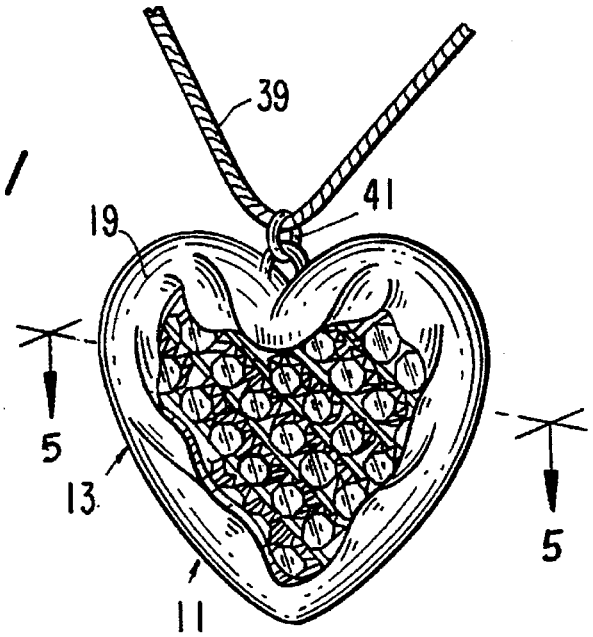
FIG. 1 is a perspective view of a jewelry pendant assembly made in accordance with the invention.

Front frame member 15 defines a running lip or border 21, the surface of which engages the corresponding surface of back frame member 17 when assembled, as will be described in greater detail below. Front frame member 15 further includes an inwardly running edge 24 which defines a window 22 therethrough. Window 22 is used for viewing stone array 31, as best shown in FIG. 1 and described hereinafter.

Referring once again to FIG. 2, back frame or backplate member 17 includes an exposed surface 29 and a hidden surface 30 (see FIG. 4). In the specific embodiment shown on the drawings, front frame member 15 and back frame member 17 have a substantially heart-shaped configuration, and when mounted together, form an aesthetically pleasing appearance. It is anticipated, however, that the frame of the invention can have any desired configuration.

Stone array 31, as shown in FIG. 2, comprises a series of walls or railings 33 which define a plurality of substantially square shaped settings 35. Square shaped settings 35 are sized for receiving a diamond or other precious or semi-precious stone 37 therewithin, as best shown in FIG. 3.

Turning now to FIGS. 3, 4 and 5, construction of jewelry pendant assembly 11 is now described. Jewelry stone array 31 is first mounted within front frame member 15 such that it sits up against inside surface 23. Stone array 31 is sized and shaped to fit between prongs 25, which are then bent inwardly in order to secure jewelry array 31 within frame member 15 (see FIGS. 3 and 4).

Once jewelry array 31 is fixed within front frame member 15, rear frame member 17 is then attached. In particular, rear frame member 17 is aligned and oriented so that the edge or lip thereof mates with lip 21 of front frame member 15, as best shown in FIGS. 4 and 5. In order to securely fasten frame members 15 and 17, solder 43 is applied along the interface between the lips of members 15 and 17. The solder is heated and melted in a conventional fashion in order to secure members 15 and 17 together.

A chain 39 may be used for carrying pendant assembly 11 of the invention. Chain 39 runs through a ring 41 which hooks over loop or bail 27 depending from the top of frame member 15. Chain 39 may be carried around the wearer's neck or wrist as desired. Alternatively, the pendant assembly of the invention may be pinned directly on a shirt or blouse of the wearer.

As can be appreciated, the inventive pendant assembly can have a frame with any desired design. This is because a standardized stone array is used that fits within the frame of the assembly, in which the outside stones at least in part sit underneath and are hidden by the frame. As a result, it is not necessary to cut the outside stones that define the stone array to a specific configuration. In other words, a standardized stone array can be used for a number of different shaped borders or frames.

It will thus be seen that the objects set forth above, among those made apparent from the preceding description, are efficiently attained, and since certain changes may be made in the described design and the construction set forth, without departing from the spirit and scope of the invention, it is intended that all matter contained in this description and shown in the accompanying drawings shall be interpreted as illustrative and not in a limiting sense.

It is also to be understood that the following claims are intended to cover all of the generic and specific features of invention herein described and all statements of the scope of the invention which, as a matter of language, might be said to fall therebetween.

I claim:

1. A jewelry pendant assembly comprising:

a frame member having an outside edge and an inside edge which defines a window therethrough;

a plurality of interrelated and interconnected jewelry stones mounted together in an array defining an outside border running thereabout, said plurality of stones comprising a first series of stones located adjacent said border defined by said array and a second series of stones about which said first series of stones is at least partially disposed;

wherein said array of jewelry stones is sized so as to fit substantially behind said frame member such that said outside border is completely hidden when viewed through said window of said frame member and is positioned between said inside and outside edges thereof so that said frame inside edge sits substantially over said array of stones inwardly of the outside border thereof such that each stone of said first series of stones is at least partially covered by said frame member and each stone of said second series of stones is not covered at all by said frame member and is completely viewable through said window.

2. The assembly of claim 1, further including means for retaining said array of stones behind said frame member.

3. The assembly of claim 2, wherein said retaining means comprises a plurality of prongs projecting from said frame member and adapted for capturing said array of stones.

4. The assembly of claim 1, further including a backplate member of substantially the same size and configuration as that of said frame member and, with said frame member, adapted for enclosing said array of stones therebetween.

5. The assembly of claim 4, wherein said backplate member has a border running therealong adapted for mating with the outside edge of said frame member.

6. The assembly of claim 5, wherein said frame member is heart shaped.

7. The assembly of claim 1, wherein said array includes a series of intersecting railings.

8. The assembly of claim 7, wherein said railings define a plurality of settings in which said stones are mounted.

9. A jewelry pendant assembly comprising:

a frame member having an outside edge and an inside edge which defines a window therebetween;

a plurality of interrelated interconnected jewelry stones mounted together in an array and defining an outside border running thereabout, said plurality of stones comprising a first series of stones located adjacent said border defined by said array and a second series of stones about which said first series of stones is at least partially disposed;

wherein said array of jewelry stones is positioned substantially behind said frame member such that said outside border is completely hidden when viewed through said window of said frame member and is positioned between said inside and outside edges thereof so that said frame inside edge sits substantially over said array of stones inwardly of the outside border thereof such that said first series of stones are at least somewhat covered by said frame member and said second series of stones are not at all covered by said frame member and are completely viewable through said frame member window.

10. The assembly of claim 9, further including means for retaining said array of stones behind said frame member.

11. The assembly of claim 10, wherein said retaining means comprises a plurality of prongs projecting from said frame member and bent for capturing said array of stones.

12. The assembly of claim 9, further including a backplate member of substantially the same size and configuration as that of said frame member and, with said frame member, enclosing said array of stones therebetween.

13. The assembly of claim 12, wherein said backplate member has a bordering lip running therealong and mated with the outside edge of said frame member.

14. The assembly of claim 9, wherein said frame member is heart shaped.

15. The assembly of claim 14, wherein said railings defines a plurality of settings in which said stones are mounted.

16. The assembly of claim 9, wherein said array includes a series of intersecting railing.

17. A jewelry pendant assembly comprising:

a frame member having an outside edge and an inside edge which defines a window therethrough;

a series of interrelated and interconnected jewelry stones mounted together in an array defining an outside border running therebout;

wherein said array of jewelry stones is sized so as to fit substantially behind said frame member such that said outside border is completely hidden when viewed through said window of said frame member and is positioned between said inside and outside edges thereof so that said frame inside edge sits substantially over said array of stones inwardly of the outside border thereof;

further including a backplate member of substantially the same size and configuration as that of said frame member and, with said frame member, adapted for enclosing said array of stones therebetween.

* * * * *